United States Patent [19]

Smith et al.

[11] Patent Number: 4,542,735

[45] Date of Patent: Sep. 24, 1985

[54] GAS FIRES

[75] Inventors: Kenneth G. Smith, Cuffley; John Collings, London, both of England

[73] Assignee: Thorn Emi Gas Appliances Limited, London, England

[21] Appl. No.: 692,862

[22] Filed: Jan. 18, 1985

Related U.S. Application Data

[63] Continuation of Ser. No. 538,898, Oct. 4, 1983, abandoned.

[51] Int. Cl.[4] ..... F24C 3/00

[52] U.S. Cl. ..... 126/129; 126/127; 126/92 AC

[58] Field of Search ..... 126/127, 128, 129, 103, 126/116 R, 85 B, 86, 87, 88, 89, 92 AC, 92 R, 69, 75; 431/326, 328

[56] References Cited

U.S. PATENT DOCUMENTS

| | | | |
|---|---|---|---|
| 2,360,611 | 10/1944 | Leonard | 126/127 X |
| 2,598,602 | 5/1952 | Raulston | 126/92 AC |
| 3,696,801 | 10/1972 | Whitehead | 126/127 X |

FOREIGN PATENT DOCUMENTS

| | | | |
|---|---|---|---|
| 295766 | 8/1928 | United Kingdom . | |
| 394350 | 6/1933 | United Kingdom . | |
| 399196 | 9/1933 | United Kingdom . | |
| 429115 | 5/1935 | United Kingdom . | |
| 1266319 | 3/1972 | United Kingdom . | |
| 1486640 | 9/1977 | United Kingdom . | |
| 1536339 | 12/1978 | United Kingdom | 126/127 |

*Primary Examiner*—Randall L. Green

*Attorney, Agent, or Firm*—Fleit, Jacobson, Cohn & Price

[57] ABSTRACT

A gas fire has a fire bed shaped to receive simulated solid fuel. Gas burners direct flames onto the firebed through the simulated fuel and out through a heat exchanger. The fuel glows in an appealing manner.

7 Claims, 2 Drawing Figures

6
-5-
4
8b
9
8
2c
8a
9a
1
8c
8
3
7
2a
2

6
-5-
4
8b
9
8
11
2c
9a
8a
1
8c
8
3
10
7
2a
2

GAS FIRES

This application is a continuation of application Ser. No. 538,898, filed Oct. 4, 1983 now abandoned.

BACKGROUND OF THE INVENTION

This invention relates to gas fires and more particularly to gas fires which incorporate simulated solid fuel, for example, logs or coals.

It is well known to incorporate simulated solid fuel in gas fires and attempts have been made to render the simulated fuel as realistic as possible.

SUMMARY OF THE INVENTION

It is an object of the present invention to provide a gas fire in which glow from the simulated fuel is enhanced.

It is another object of the invention to increase the efficiency of open-fronted fuel-effect type gas fires above that of gas fires of a similar kind already known in the prior art.

According to the present invention there is provided a gas fire having simulated solid fuel, the fuel being hollow and having an opening through which hot combustion products are capable of being passed, means to guide, in use, the hot combustion products through the fuel such that movement of combustion products upwardly away from the fuel is substantially inhibited and a heat exchanger for conveying combustion products away from the fire after having been passed through the fuel, the passage of the combustion products through the fuel heating its interior and causing the fuel to glow.

Preferably, the fuel is mounted on a firebed of refractory material and a gas burner or burners provided to direct flame at or along the fire bed, the burner and fire bed comprising said guiding means. Additionally, an interior surface of the fuel may be shaped to help guide the hot combustion products through the fuel.

The fuel may comprise individual portions, each portion representing a log or coal and the firebed may be suitably shaped to locate each individual portion. At least some of the individual portions may be open-ended tunnels through which the combustion products are passed.

The gas fire may be provided with a heat exchanger for conveying combustion products away from the fire after having been passed through the fuel, the heat exchanger and simulated fuel being co-operable in use, to substantially inhibit movement of combustion products upwardly away from the fuel. Preferably, the fuel is shaped adjacent an entrance of the heat exchanger to direct combustion products thereinto.

An embodiment of a gas fire in accordance with the invention will now be described, by way of example only, with reference to the accompanying figures, wherein:

DRAWING DESCRIPTION

FIG. 1 shows a diagrammatic sectional side elevation of the fire, and illustrates the flow of air and combustion products through the fire, and, FIG. 2 shows the same diagrammatic sectional side elevation as in FIG. 1, but with the inclusion of an additional feature of the invention to further enhance the glowing effect of the fire.

DETAILED DESCRIPTION

Figure 1:
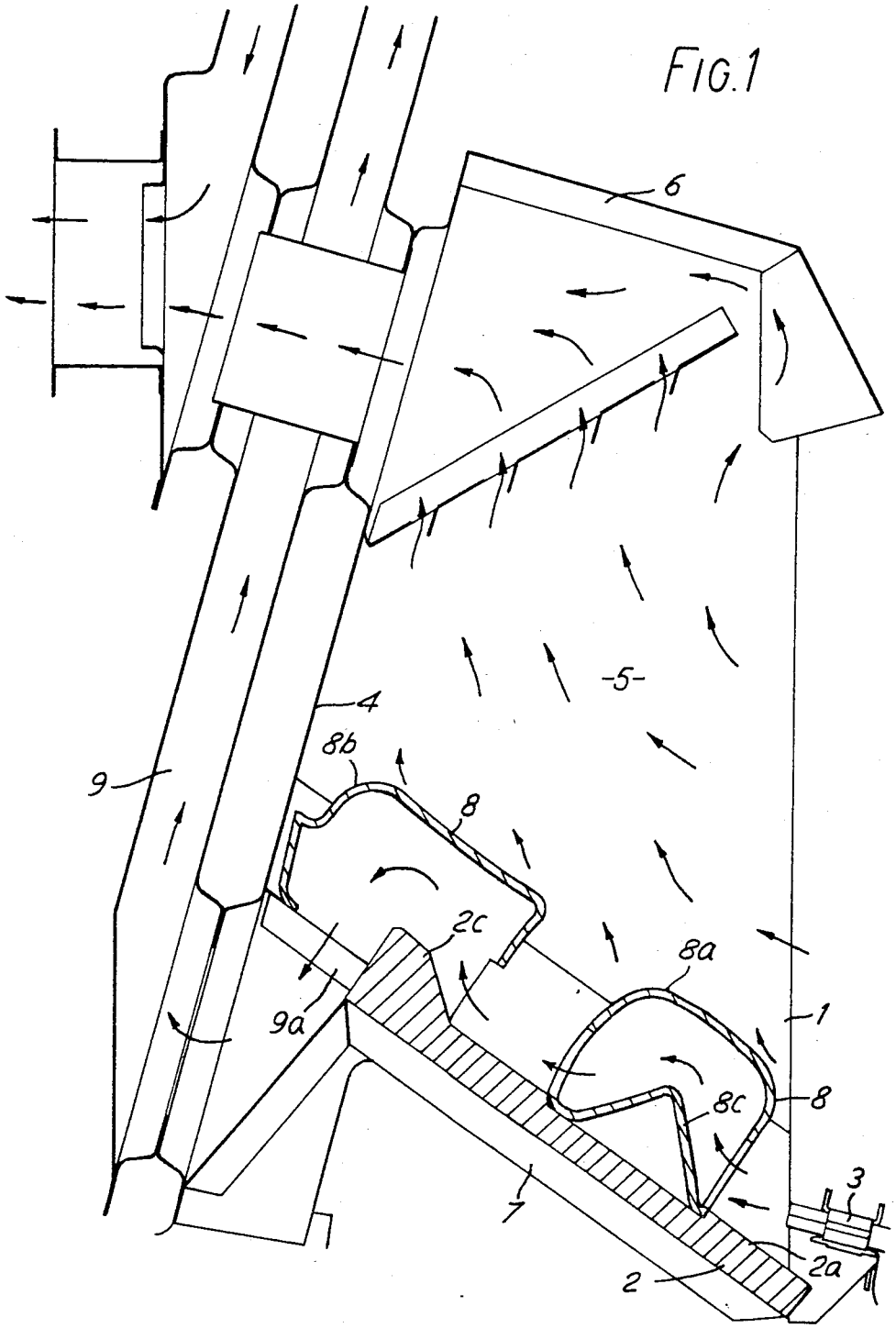

FIG. 1 shows a gas fire having an open-fronted combustion chamber 1, and a fire bed 2 mounted for heating by an array of gas burners 3 (only one such burner being shown in the figure). The combustion chamber 1, which is made of sheet metal, has an inclined rear wall 4, side walls 5 and upper and lower end walls 6 and 7 respectively. The fire bed 2 comprises a shaped plate of ceramic or other refractory material and is mounted at a shallow angle to the horizontal. The three gas burners 3 are mounted, in conventional manner, in a row extending across the front of the fire so as to direct an array of broad, flat flames substantially across the upper surface 2*a* of the fire bed 2. It will be appreciated, however, that any number of burners may be provided and arranged in configuration to suit. Refractory material elements 8, shaped to simulate solid fuel, e.g. coals or logs, are supported on the fire bed 2. As is well known in the art, such elements may be made of a lightweight, thermal shockproof ceramic material.

Figure 2:
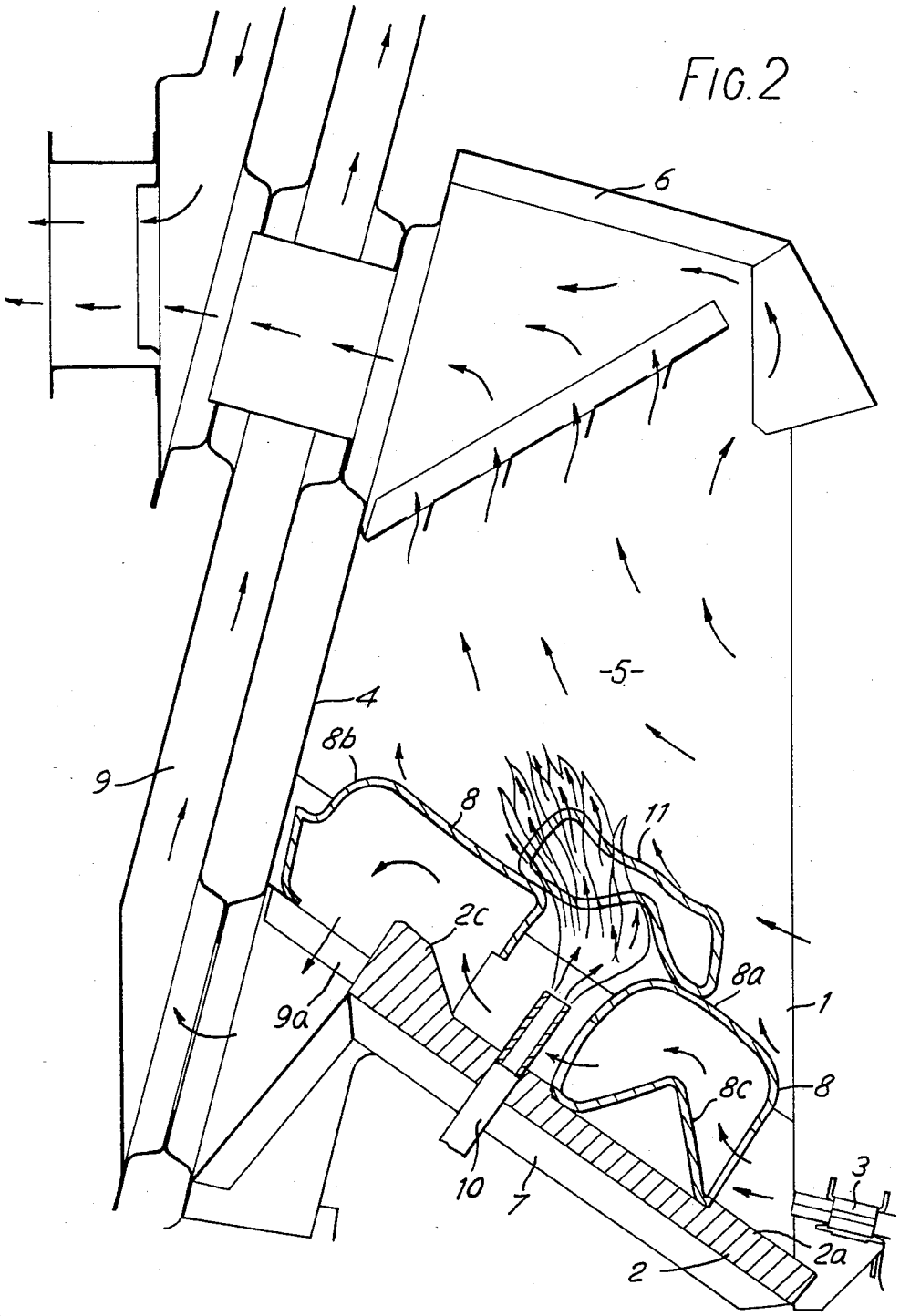

The simulated fuel comprises individual portions 8 located on the firebed 2. Two such portions are shown in FIG. 2, portion 8*a* being an open-ended tunnel and located in a shaped recess in upper surface 2*a* and portion 8*b* being a back portion shaped to direct combustion products into entrance 9*a* of a heat exchanger 9. The heat exchanger 9 is described fully in our copending U.S. application Ser. No. 538,899, now U.S. Pat. No. 4,489,707. Fuel portion 8*a* is provided with a lower inverted V-shaped surface 8*c* shaped to guide combustion products from the burner and around the interior of said portion and along to the portion 8*b*. The firebed is provided with a raised inclined back 2*c* to act for fuel portion 8*b* in a similar way as surface 8*c* acts for fuel portion 8*a*. Together the burners 3, firebed 2 and interior shape of the fuel act to guide combustion products from the front to the back of the firebed, through the fuel and out through heat exchanger 9.

The effect produced is that the simulated fuel glows in a warm appealing manner, and at the same time the combustion products generated by the burners 3 is largely prevented from mixing with relatively cold air in the combustion chamber 1 before entering the heat exchanger, by co-operation of the fuel and heat exchanger. Substantially inhibiting upward movement of combustion products away from the fuel and firebed increases the efficiency of the gas fire.

Additionally, means may be provided on the gas fire to pass neat gas through tubes or passageways in the simulated fuel for ignition by the flames already flowing through the fuel. Referring now to FIG. 2, in which the reference numbers refer to the same parts of the diagram as those shown in FIG. 1, a neat gas tube is shown at 10. An additional portion 11 of simulated fuel is also shown therein, indicating the passage of the gas through the simulated fuel, thus providing an enhanced and more random free flame appearance of the fuel.

We claim:

1. A gas fire including:

an open-fronted combustion chamber, a fire bed arranged within the combustion chamber, simulated solid fuel supported on the fire bed and arranged to provide a desired visual effect, a gas burner arranged adjacent to the front of the fire bed and disposed to direct flames at the fire bed and the simulated solid fuel, and a heat exchanger unit for heating ambient air to receive combustion products associated with said flames and to utilise the products to heat the ambient air, said unit having an inlet for combustion products adjacent the rear of the fire bed, wherein at least selected portions of said simulated solid fuel are formed with internal passageways, said passageways opening towards said flames and having means provided to guide said combustion products generally along the fire bed to the inlet, wherein some simulated fuel portions are provided with an inner V-shaped surface to guide combustion products around the interior of said respective portion, the inner V-shaped surfaces comprising, or at least providing a part of, said shaped interior surface of the fuel, the combustion products heat interior surfaces of the solid fuel through which they pass causing it to glow and are constrained to remain in the vicinity of said fire bed along their entire path from said gas burner to said inlet.

2. A fire as claimed in claim 1 in which the guiding means comprises a firebed of refractory material on which the fuel is mounted.

3. A fire as claimed in claim 2 in which the guiding means comprises a shaped interior surface of the simulated solid fuel.

4. An apparatus for a fire as claimed in claim 1 in which the fuel comprises individual portions, each fuel portion representing, for example, a log or coal.

5. An apparatus for a fire as claimed in claim 1 in which the fuel is shaped adjacent an entrance of the heat exchanger to direct combustion products thereinto.

6. An apparatus for a fire as claimed in claim 1 in which means is provided to pass neat gas through tubes or passageways located in the fuel for ignition by flames which, in use, flow through the fuel.

7. An apparatus for a gas fire as claimed in claim 1 in which the guiding means also comprises a shaped interior surface of the simulated fuel.

* * * * *